US007580013B2

(12) United States Patent
Yaguma et al.

(10) Patent No.: US 7,580,013 B2
(45) Date of Patent: Aug. 25, 2009

(54) ORGANIC EL DRIVE CIRCUIT IC

(75) Inventors: Hiroshi Yaguma, Kyoto (JP); Shinichi Abe, Kyoto (JP); Masato Kobayashi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 614 days.

(21) Appl. No.: 11/156,535

(22) Filed: Jun. 21, 2005

(65) Prior Publication Data

US 2006/0001619 A1 Jan. 5, 2006

(30) Foreign Application Priority Data

Jun. 22, 2004 (JP) ..... 2004-183486

(51) Int. Cl.
*G09G 3/30* (2006.01)

(52) U.S. Cl. ..... 345/77; 345/82

(58) Field of Classification Search ..... 345/76–84, 345/204; 315/169.3; 348/800
See application file for complete search history.

(56) References Cited

U.S. PATENT DOCUMENTS 6,169,532 B1 * 1/2001 Sumi et al. ..... 345/98
6,963,172 B2 * 11/2005 Maede et al. ..... 315/169.1
7,126,568 B2 * 10/2006 LeChevalier ..... 345/84
7,292,234 B2 * 11/2007 Kitahara ..... 345/76
7,345,685 B2 * 3/2008 Miyazawa ..... 345/207
7,515,124 B2 * 4/2009 Yaguma et al. ..... 345/77
2004/0104870 A1 * 6/2004 Mametsuka ..... 345/76
2005/0099368 A1 * 5/2005 Abe et al. ..... 345/76

FOREIGN PATENT DOCUMENTS

JP 9-232074 9/1997
JP 2000-276108 6/2000

* cited by examiner

*Primary Examiner*—Chanh Nguyen
*Assistant Examiner*—Allison Walthall
(74) *Attorney, Agent, or Firm*—Mattingly & Malur, PC

(57) ABSTRACT

An organic EL drive circuit includes a reset voltage generator circuit for generating a predetermined constant voltage for constant voltage resetting, reset switches provided between an output of the reset voltage generator circuit and terminal pins of an organic EL display panel and ON/OFF controlled by one of the timing control signal, a reset control signal similar to the timing control signal, a reset pulse, other pulse generated in the reset period in synchronism with these signal, and the pulse and an output terminal for outputting the predetermined constant voltage to other organic EL drive circuits, which have identical circuit constructions to that of the organic EL drive circuit and arranged adjacent to the organic EL drive circuit, as a voltage for constant voltage resetting.

4 Claims, 3 Drawing Sheets

ORGANIC EL DRIVE CIRCUIT IC

BACKGROUND OF THE INVENTION

1. Field of the Invention

The present invention relates to an organic EL drive circuit and an organic EL display device using the same organic EL drive circuit. In particular, the present invention relates to an organic EL drive circuit IC capable of reducing luminance unevenness on a display screen in the low tone region between drive circuit IC's driven by the current tone system, and an organic EL display device using the same organic EL drive circuit IC.

2. Description of the Related Art

A drive circuit for driving passive matrix type organic EL elements and resetting the organic EL elements by grounding anodes and cathodes of the organic EL elements is disclosed in JPH9-232074A.

On the other hand, a drive circuit of a liquid crystal display device, which drives a data line by a D/A converter circuit, is known. When a plurality of such drive circuits of the liquid crystal display device are applied to pixel circuits of an active matrix type organic EL display panel and are housed in the display panel, down sizing of the organic EL display panel is difficult as disclosed in JP2000-276108A.

However, when the organic EL drive circuit for driving the active matrix type EL display panel is provided externally of the display panel, the down sizing of the organic EL display panel can be achieved to some extent. In such case, write of drive current is performed by charging each of capacitors of pixel circuits, whose capacitance is usually several hundreds pF, with drive current in the order of 0.1 μA to 10 μA. However, when luminance of the active matrix type organic EL display panel is to be tonally controlled, highly precise drive current having minimum current value of about 1 nA to 30 nA is required. There are two types of flowing direction of the drive current, the sink type and the source type. Voltage of a power source line +Vcc is presently about 10V to 20V regardless of the type of the organic EL display panel, the passive matrix type or the active matrix type.

Incidentally, luminance unevenness in the low tone region of a display screen tends to become conspicuous due to visual sensitivity of human. Drive current in the low tone region becomes small and, when a capacitor or an organic EL element, which is a capacitive load, is driven, a portion of the driving current, which does not attribute to light emission, is consumed by initially charging the load. Therefore, it is impossible to obtain sufficient light emission corresponding to a drive current difference, so that luminance unevenness tends to occur. In view of this fact a voltage drive system is proposed for the low tonal region, in lieu of the current drive system.

However, when a voltage drive circuit is used as the drive circuit of the current tone system, there is a problem that the circuit size of the drive circuit is increased correspondingly. In addition, in the current sink type display panel, the voltage for resetting a capacitor of a pixel circuit of an organic EL display panel becomes in the vicinity of the voltage of the power source line +Vcc. Therefore, variation of reset voltage between drive circuit IC's tends to occur, resulting in conspicuous difference in luminance in a boarder area between the drive circuit IC's in the low tone region.

SUMMARY OF THE INVENTION

An object of the present invention is to provide an organic EL drive circuit, which can reduce luminance unevenness on a display screen in the low tone region between drive circuit IC's driven by the current tone system.

Another object of the present invention is to provide an organic EL display device using the same organic EL drive circuit.

In order to achieve the above mentioned object, according to the present invention, an organic EL drive circuit IC for resetting organic EL elements or capacitors of pixel circuits through terminal pins of an organic EL display panel in a reset period of a timing control signal, which has a predetermined frequency and has a display period corresponding to a scan period for one horizontal line and the reset period corresponding to a retrace period of a horizontal scan, comprises a reset voltage generator circuit for generating a predetermined constant voltage for resetting the organic EL elements or the capacitors to constant voltage, a plurality of reset switches provided between an output of the reset voltage generator circuit and said terminal pins and ON/OFF controlled by one of the timing control signal, a reset control signal similar to the timing control signal, a reset pulse or other pulse generated in the reset period in synchronism with these signal, or the pulse and an output terminal for outputting the predetermined constant voltage to other drive circuit IC having similar circuit construction to that of the organic EL drive circuit IC and provided adjacent to the organic EL drive circuit IC as a voltage for constant voltage resetting.

Since, according to the present invention, the reset voltage generator circuit is provided and the predetermined constant voltage for constant voltage resetting can be transmitted from one of the drive circuit IC's to other drive circuit IC arranged adjacently to the one drive circuit IC, it is possible to make the reset voltages of a plurality of drive circuit IC's substantially equal.

As a result, there is substantially no difference in reset voltage in the boarder area between the one drive circuit IC and the other drive circuit IC adjacent thereto and, therefore, it is possible to reduce luminance unevenness due to drive current difference in the boarder area of the drive circuit IC's in the low tone region in which the drive current is small even when adjacent terminal pins of the organic EL display panel are driven by different drive circuit IC's.

As a result, it is possible to reduce luminance unevenness on the display screen in the low tone region between the drive circuit IC's by the current tonal system.

DETAILED DESCRIPTION OF THE PREFERRED EMBODIMENTS

Figure 1:
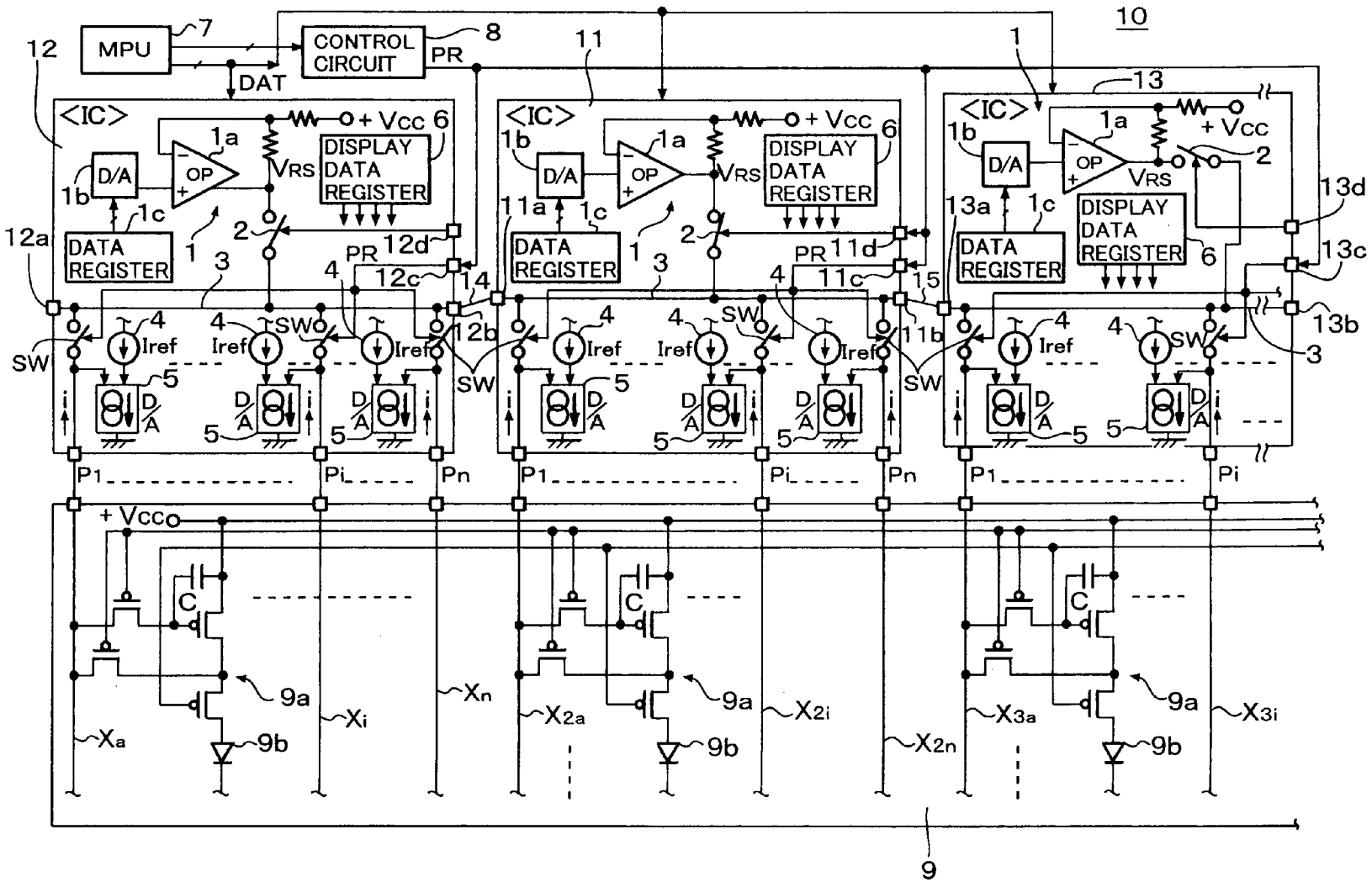
FIG. 1 is a block circuit diagram of an organic EL display panel to which an organic EL drive circuit according to an embodiment of the present invention is applied.

In FIG. 1, a reference numeral 10 depicts an active matrix type organic EL display device and reference numerals 11, 12 and 13 depicts drive circuit IC's each having an organic EL drive circuit.

The organic EL drive circuits of the drive circuit IC's 11, 12 and 13 have identical circuit constructions and are arranged close by to drive terminal pins of an organic EL display panel 9, which are arranged in a column direction, evenly. Each of the three drive circuit IC's includes a constant voltage reset circuit.

The constant voltage reset circuit is constructed with a reset voltage generator circuit 1, analog switch 2 and a reset switch SW and operates by a precharge pulse PR outputted by a control circuit 8.

The drive circuit IC 11 arranged between the drive circuit IC's 12 and 13 is a master driver and the drive circuit IC's 12 and 13 are slave drivers. The slave driver circuit IC's 12 and 13 respond to a reset voltage for resetting capacitors of pixel circuits, which is supplied by the master drive circuit IC 11 to reset the capacitors of the pixel circuits each connected to the terminal pins allotted thereto.

In another embodiment shown in FIG. 3, a master drive circuit IC supplies a constant voltage, which is lower than the reset voltage, to the slave drive circuit IC's 12 and 13 to generate a reset voltage, which is higher than the constant voltage, in each of the slave driver IC's 12 and 13, as to be described later.

Embodiment 1

In FIG. 1, each of the drive circuit IC's 11 to 13 includes a reset voltage generator circuit 1, an analog switch 2, a reset voltage output line 3,a plurality of current sources 4 provided correspondingly to respective terminal pins of an organic EL display panel 9 and a plurality of D/A converter circuit 5 as an output stage current source.

Each D/A converter circuit 5 is supplied with a reference current Iref distributed by a reference current distributor circuit (only the current sources 4 thereof are shown) and outputs a sink drive current i. The thus generated drive currents are supplied to the respective terminal pins.

The reference current distributor circuit distributes the reference current Iref generated by a reference current generator circuit (not shown) to the respective D/A converter circuits 5. The current source 4 of the reference current distributor circuit corresponds to an output circuit for outputting the distributed reference current Iref to the D/A converter circuit 5 corresponding thereto.

Each D/A converter circuit 5 is a current switching type D/A converter circuit constructed with a current mirror circuit and is responsive to the reference current i and a display data DAT, which is supplied from a display data register 6, to generate a drive current (sink current) i corresponding to a display luminance every moment by amplifying the reference current Iref correspondingly to a value of the display data.

The output currents of the D/A converter circuits 5 are sent to pixel circuits 9*a* of an active matrix type organic EL display panel 9 through output terminals P1 . . . Pi . . . Pn on a column (data line) side, respectively. Capacitors C provided in the respective pixel circuits 9*a* are charged by the output currents of the D/A converter circuits 5, respectively. As a result, organic EL elements 9*b* of the pixel circuits 9*a* are driven by the drive currents i corresponding to charged voltages of the capacitors C, respectively.

Incidentally, reference numerals 7 and 8 depict an MPU and a control circuit, respectively. The display data DAT of the display data register 6 is set in the MPU 7. The terminal pins of the data line (column line) of the organic EL display panel 9, which correspond to output terminals P1 . . . Pi . . . Pn of the drive circuit IC's 11 to 13 are shown by Xa . . . X1 . . . Xn, X2*a* . . . X2*i* . . . X2*n*, X3*a* . . . X3*i* . . . X3*n*.

In a color display using R, G and B primary colors, the current source 4 and the D/A converter circuit 5 are provided for terminal pins of each of R, G and B colors. In the following description, the embodiment will be described for the organic EL drive circuit for any one of R, G and B colors since color is not directly related to the present invention.

Reference numerals 11*a* and 11*b* show input/output terminals (I/O terminals) of the drive circuit IC 11, respectively. The I/O terminals 11*a* and 11*b* are provided in opposite sides of the drive circuit IC 11 correspondingly to one side of said adjacent drive circuit IC's 12 and 13.

Similarly, I/O terminals 12*a* and 12*b* and I/O terminals 13*a* and 13*b* are provided for the drive circuit IC's 12 and 13, respectively. The I/O terminals 11*a* to 13*a* and 11*b* to 13*b* are selected from terminal pins of the drive circuit IC's, which are arranged in four sides of each of the rectangular drive circuit IC's. That is, the I/O terminals are selected from the terminal pins, which are arranged in faced sides of the adjacently arranged drive circuit IC's and in substantially corresponding positions.

The I/O terminals 11*a* to 13*a* and 11*b* to 13*b* are connected together by a reset voltage output line 3 in the respective drive circuit IC's 11 to 13.

The I/O terminal 11*b* of the drive circuit IC 11 is connected to the I/O terminal 12*a* of the drive circuit IC 12 arranged adjacent to the drive circuit IC 11 through an external wiring line 14 and the I/O terminal 12*b* of the drive circuit IC 12 is connected to the I/O terminal 13*a* of the drive circuit IC 13 arranged adjacent to the drive circuit IC 11 through an external wiring line 15.

Output terminals of the reset voltage generator circuits 1 of the drive circuit IC's 11 to 13 are connected to the reset voltage output line 3 through the analog switches 2, respectively. One ends of reset switches SW (analog switches) provided correspondingly to the output terminals P1 . . . Pi . . . Pn are connected to the output terminals P1 . . . Pi . . . Pn, respectively, and other ends of the reset switches SW are commonly connected to the reset voltage output line 3.

The reset voltage generator circuit 1 is constructed with an operational amplifier (OP) 1*a*, a D/A converter circuit (D/A) 1*b* and a data register 1*c*.

The operational amplifier 1*a* is non-inversion type amplifier operable with power supply from the power source line +Vcc and outputs a reset voltage VRS to the reset voltage output line 3 by amplifying the output voltage of the D/A converter circuit 1*b* supplied to the (+) input thereof with a predetermined amplification factor. The output of the operational amplifier 1*a* is generated in a connecting point located in substantially a center position of the reset voltage output line 3 (see FIG. 1). A (−) input of the operational amplifier 1*a* is connected to the power source line +Vcc through a reference resistor. A voltage of the power source line +Vcc is in the order of 5V to 20V and the reset voltage VRS is lower than the voltage of the power source line +Vcc by a few or several volts.

The D/A converter circuit 1*b* takes in the form of a resistance-division ladder type D/A converter circuit. The D/A converter circuit 1*b* generates the reset voltage VRS by converting the data from the MPU 7, which is set in the data register 1*c*. Therefore, a programmable regulation of the reset voltage VRS can be done according to the data set in the data register 1*c*.

Incidentally, the MPU 7 sets the data for generating the reset voltage in the data register 1*c* at a time when the power source is turned ON. The data is stored in a non-volatile memory of the MPU 7.

The reset switches SW of the drive circuit IC's 11 to 13 are kept ON state in a "H" period (precharge period) of a precharge pulse PR (see FIG. 2*c*) supplied to the drive circuit IC's 11 to 13 through the input terminals 11*c*, 12*c* and 13*c* thereof, respectively. The operational amplifier 1*a* of the drive circuit IC 11 is kept steady operation state to generate the reset voltage VRS during the precharge pulse PR is in "H" state and the operational amplifier 1*a* of the drive circuit IC 11 is kept idling state during the precharge pulse PR is in "L" state (see FIG. 2*c*).

Further, the precharge pulse PR is supplied to an input terminal 11*d* of the master drive circuit IC 11 to keep the analog switch 2 ON in the precharge period in which the precharge pulse is in "H" state. The precharge pulse PR is not supplied to input terminals 12*d* and 13*d* of the slave drive circuit IC's 12 and 13. Therefore, the analog switches of the slave drive circuit IC's are kept OFF state during the precharge pulse PR is in "H" state.

Incidentally, the precharge pulse PR is a reset pulse, which is generated in a reset period RT in the active matrix type organic EL display panel. In the precharge period or the reset period RT (see FIG. 2*a*), cathode sides of organic EL elements 9*b* for on horizontal line, which are to be reset, are grounded.

The analog switch 2 of the drive circuit IC 11 is kept ON during the precharge pulse PR is in "H" state and sets the reset voltage output line 3 to the reset voltage VRS. As a result, the reset voltage VRS is outputted to the output terminals P1 . . . Pi . . . Pn of the drive circuit IC 11 through the reset switches SW, which are ON during the precharge pulse PR is in "H" state. Further, the reset voltage VRS is supplied to the reset voltage output line 3 through the I/O terminals 11*a* and 11*b* and the wiring lines 14 and 15.

As a result, the reset voltage VRS is also supplied to the output terminals P1 . . . Pi . . . Pn of the drive circuit IC's 12 and 13. Therefore, the terminal pins of the organic EL display panel 9 for one horizontal line are simultaneously set to the reset voltage VRS, so that the capacitors C of the pixel circuits 9*a* for one horizontal line are simultaneously reset to the reset voltage VRS.

Incidentally, since, in this case, the analog switches 2 of the drive circuit IC's 12 and 13 are in OFF state, the reset voltage generator circuits 1 of the drive circuit IC's 12 and 13 do not contribute to the reset operation.

Figure 2:
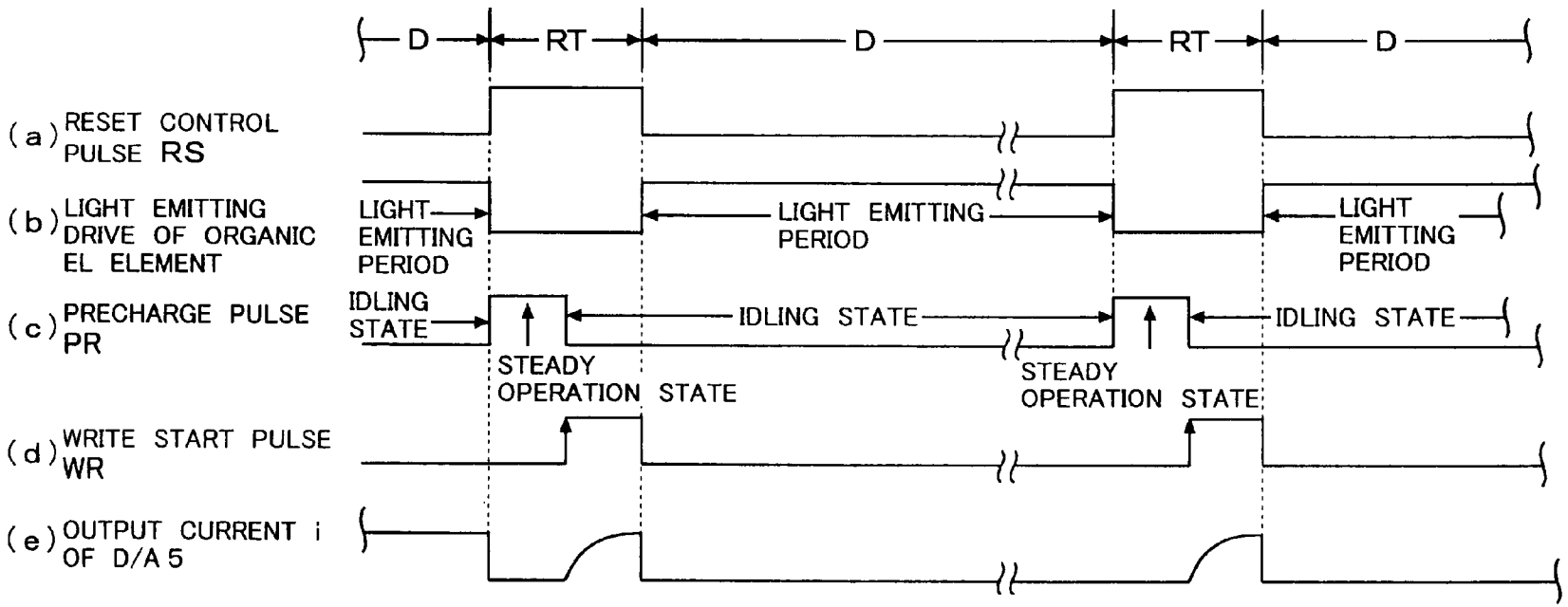
FIG. 2 shows a timing chart for the constant voltage resetting.

Although, in the active matrix type organic EL display panel, the precharge pulse PR and the reset control pulse RS rise simultaneously, a width of the precharge pulse PR is slightly shorter than that of the reset control pulse RS as shown in FIG. 2*a* and FIG. 2*c*. In the reset period RT, a write start pulse WR (see FIG. 2*d*) for writing a drive current in the capacitors C of the pixel circuits 9*a* is generated after "H" state of the precharge pulse PR is ended. With this write start pulse WR, the drive current i (see FIG. 2*e*) is written in the capacitors of the pixel circuits 9*a* as voltage values, respectively, and the reset period RT is ended when the write is completed.

The reset control pulse RS shown in FIG. 2*a* is a timing control signal having a predetermined frequency, for dividing a display period D corresponding to a scan line for one horizontal line from the reset period RT corresponding to retrace period of horizontal scan. Since the write start pulse is unnecessary in the passive matrix type organic EL display panel, the reset control pulse RS usually acts as the rest pulse. In such case, the analog switch 2 and the reset switch SW of the drive circuit IC 11 are ON during the period in which the reset control pulse RS is in "H" state. In the passive matrix type organic EL panel, the lines Xa . . . Xi . . . Xn, X2*a* . . . X2*i* . . . X2*n*, X3*a* . . . X3*i* . . . X3*n* of the active matrix type organic EL display panel 9 act as column lines to which the organic EL elements are directly connected. Drive current i for the passive matrix type organic EL display panel is larger than that of the active matrix type organic EL display panel 9. The passive matrix type organic EL display panel is substantially the same as that of the active matrix type organic EL display panel 9 except the reset voltage and the above mentioned matters.

As a result, the output terminals P1 . . . Pi . . . Pn of the drive circuit IC's 11 to 13 are simultaneously supplied with the constant voltage VRS outputted from the operational amplifier 1*a* and the capacitors C of the pixel circuits 9*a* are reset to a constant voltage and, thereafter, the drive current is written in.

Incidentally, in the passive matrix type organic EL display panel, the organic EL elements for one horizontal line are directly reset to the constant voltage VRS through the column lines. Therefore, when the drive current i is discharged, the reset voltage VRS becomes a predetermined constant voltage, which is lower, with ground potential as a reference, than a voltage with which the organic EL element emits light.

In the embodiment shown in FIG. 1, the master drive circuit IC 11 is arranged between the slave drive circuit IC's 12 and 13. Since the output voltage of the operational amplifier 1*a* is generated at the connecting point located in the substantial center position of the set voltage output line 3, the reset voltage of the capacitors C of the pixel circuits 9*a* arranged in a center portion of the column direction of one horizontal line is slightly higher with respect to the column pins of one horizontal line and slightly lower in both end portions thereof. However, the reset voltage is substantially flat totally. Therefore, there is substantially no considerable difference in reset voltage in boarder areas of these drive circuit IC's even when there is slight difference in the drive characteristics (drive currents of the respective output terminals) in a low tonal region in which drive current is small. Consequently, luminance unevenness in the boarder area of the drive circuit IC's even when adjacent terminal pins are driven by different drive circuit IC's.

Embodiment 2

Figure 3:
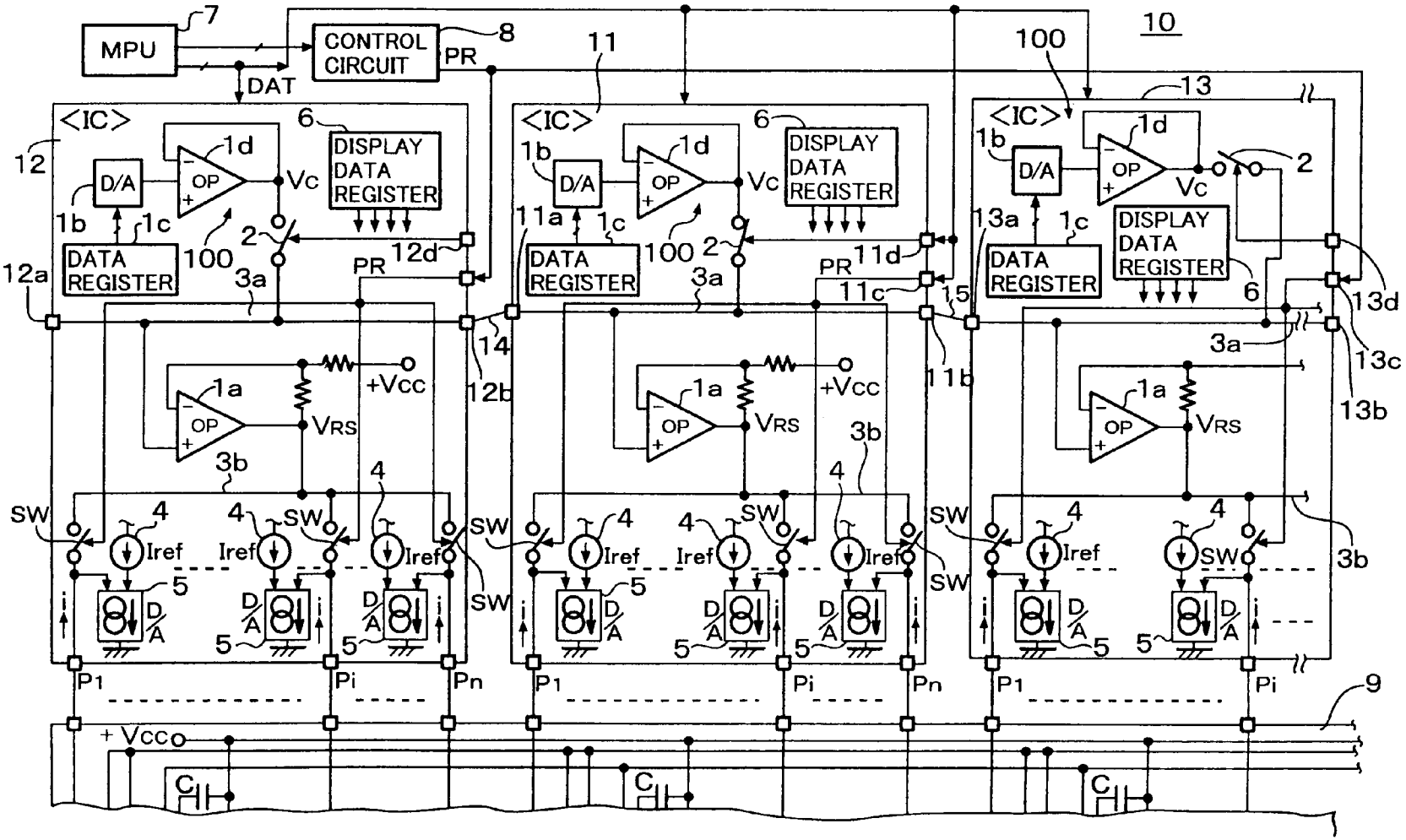
FIG. 3 is a block circuit diagram of an organic EL display panel to which an organic EL drive circuit according to another embodiment of the present invention is applied.

FIG. 3 is a block circuit diagram of another embodiment of the present invention. In FIG. 3, the master drive circuit IC 11 outputs a constant voltage Vc lower than the reset voltage VRS to the slave drive circuit IC's 12 and 13.

A reset voltage generator circuit 100 of each of the drive circuit IC's 11, 12 and 13 in FIG. 3 includes a buffer amplifier (voltage follower operational amplifier) 1*d* between the operational amplifier 1*a* and the D/A converter circuit 1*b* of the reset voltage generator circuit 1 shown in FIG. 1.

In this embodiment, each of the reset voltage output lines 3 shown in FIG. 1 is sectioned to a constant voltage output line 3*a* and a reset switch connecting line 3*b*. The constant voltage output lines 3*a* are connected to the I/O terminals for outputting the constant voltage Vc to the adjacent drive circuit IC's, similarly to the reset voltage output lines 3 in FIG. 1. The reset switch connecting lines 3*b* commonly connect one ends of the reset switch SW the other ends of which are connected to the output terminals P1 . . . Pi . . . Pn, respectively.

An output terminal of each buffer amplifier 1*d* is connected to the constant voltage output line 3*a* through the analog switch 2 and an output of the buffer amplifier 1*d* is inputted to a (−) input thereof. The buffer amplifier 1*d* amplifies the output voltage of the D/A converter circuit 1*b* supplied to its (+) input with a predetermined amplification factor and outputs the constant voltage Vc to the constant voltage output line 3*a*. The constant voltage Vc is lower than the reset voltage VRS in the embodiment shown in FIG. 1. Thus, the voltage to be transmitted to other drive circuit IC's is restricted to a lower voltage and the driving capability of the operational amplifier 1*a* housed in each drive circuit IC is lowered compared with the embodiment shown in FIG. 1.

The operational amplifier 1*a* is provided between the constant voltage output line 3*a* and the reset switch connecting line 3*b*. That is, the output terminal of the buffer amplifier id and the (+) input of the operational amplifier 1*a* are connected to the constant voltage output line 3*a* and the output of the operational amplifier 1*a* is connected to the reset switch connecting line 3*b*.

Thus, the constant voltage Vc from the buffer amplifier 1*d* of the drive circuit IC 11 is sent to the constant voltage output lines 3*a* of the drive circuit IC's 12 and 13 through the constant voltage output lines 3*a* and the I/O terminals 11*a* and 11*b* of the drive circuit IC 11. The operational amplifiers 1*a* of the drive circuit IC's 11 to 13 are driven by the constant voltage Vc of the constant voltage output lines 3*a* to generate the reset voltages VRS.

According to the embodiment shown in FIG. 3, it is not required to transmit the high reset voltage VRS as in the reset voltage generator circuit 1 shown in FIG. 1 and it is possible to generate the reset voltages VRS by individual operations of the operational amplifiers 1*a* housed in the respective drive circuit IC's. As a result, it is possible to restrict the driving capability of each operational amplifier 1*a* correspondingly.

As described hereinbefore, in the embodiments of the present invention, the I/O terminals 11*a* to 13*a* and 11*b* to 13*b* are provided in the opposing sides of the drive circuit IC's arranged side by side and it is not always necessary to provide them in opposing positions of the opposing sides of the drive circuit IC's.

Although the reset operation is performed when the precharge pulse PR becomes "H" in the described embodiments, it is possible to start the reset operation when the precharge pulse becomes "L" in the reset period RT. Further, although the precharge pulse PR is used as the reset pulse in the described embodiments, the reset control pulse RS, the timing control pulse or other pulse, which is generated in the reset period RT in synchronism with one of these pulses, may be used as the reset pulse.

Further, although the example in which the capacitors of the pixel circuits in the active matrix type organic EL display panel are reset has been described, it is of course possible to apply the present invention to a case where terminal voltages of the organic EL elements of the passive matrix type organic EL display panel are reset to a constant voltage.

Although, in the described embodiments, three drive circuit IC's are provided in the organic EL display device, it is possible to add another slave drive circuit IC preceding to the drive circuit IC 12 and to connect the I/O terminal 12*a* of the drive circuit IC 12 to an I/O terminal of the added slave drive circuit IC through an external wiring. In such case, the reset voltage VRS of the master drive circuit IC 11 is sent to added slave drive circuit IC through the reset voltage output line 3 (constant voltage output line 3*a*) of the drive circuit IC 12. Similarly, it is possible to add another slave drive circuit IC after the drive circuit IC 13.

Therefore, the present invention can be applied to a case where four or more drive circuit IC's are provided on the column side of the organic EL display panel. The number of drive circuit IC's may be two, of course.

The operational amplifier having predetermined amplification factor, which generates the voltage for constant voltage resetting, may be any general amplifier.

Further, although the D/A converter circuit is used as the output stage current source in the described embodiments, it is possible to additionally provide a current source such as a current mirror circuit as the output stage and to drive the output state current source by the output current of the D/A converter circuit.

Although the pixel circuit is constructed with P channel MOS transistors mainly in the described embodiments, it may be constructed with N channel MOS transistors or a combination of N channel MOS transistors and P channel MOS transistors.

What is claimed is:

1. An organic EL drive circuit IC for resetting organic EL elements or capacitors of pixel circuits through terminal pins of an organic EL display panel in a reset period of a timing control signal, which has a predetermined frequency and has a display period corresponding to a scan period for one horizontal line and the reset period corresponding to a retrace period of a horizontal scan, said organic EL drive circuit IC comprising:

a reset voltage generator circuit for generating a predetermined constant voltage for resetting said organic EL elements or said capacitors to constant voltage;

a plurality of reset switches provided between an output of said reset voltage generator circuit and said terminal pins and ON/OFF controlled by a reset pulse; and an output terminal for outputting the predetermined constant voltage to an adjacent said drive circuit IC having similar circuit construction that includes a respective said reset voltage generator circuit and respective said plurality of reset switches as a voltage for constant voltage;

wherein said organic EL display panel has a plurality of said terminal pins, said organic EL drive circuit IC is rectangular in plane, said output terminals are input/output terminals and provided in opposite sides of said rectangular organic EL drive circuit IC correspondingly to one side of said adjacent drive circuit IC and connected by a wiring line provided within said organic EL drive circuit IC, said reset voltage generator circuit includes an amplifier for generating the predetermined constant voltage, the plurality of said reset switches are provided correspondingly to at least plural terminal pins of the plurality of said terminal pins, the plurality of said reset switches are simultaneously turned ON according to said reset pulse, an output of said amplifier is connected to said wiring line through a certain switch circuit, said certain switch circuit together with the plurality of said reset switches are turned ON by said reset pulse, said output terminal of said amplifier is connected to a substantial center position of said wiring line through said certain switch circuit, said organic EL drive circuit IC outputs the predetermined constant voltage to one of input/output terminals of said adjacent drive circuit IC as a slave drive circuit IC through said input/output terminal of said organic EL drive circuit IC as a master drive circuit IC; said organic EL drive circuit IC and said other adjacent drive circuit IC's have substantially the same circuit constructions, said certain switch circuit of said other adjacent slave drive circuit IC is kept OFF, the plurality of said terminal pins are connected to output stage current sources, said output stage current sources supply drive currents to said organic EL elements or said capacitors of said pixel circuits, respectively, said amplifier is an operational amplifier, the reset pulse is a precharge pulse, the predetermined constant voltage is the reset voltage, and wherein said reset voltage generator circuit includes a first D/A converter circuit, said output stage current source is constructed with a second D/A converter circuit, data for D/A conversion is set in said first D/A converter circuit, said operational amplifier is connected to a power source +Vcc through a reference resistor and is responsive to a voltage D/A converted by said first D/A converter circuit to generate the reset voltage and said second D/A converter circuit D/A converts a display data to generate the drive current.

2. The organic EL drive circuit IC as claimed in claim 1, wherein said reset voltage generator circuit includes a buffer amplifier provided between said first D/A converter circuit and said operational amplifier, said buffer amplifier is responsive to the voltage from said first D/A converter circuit to supply the voltage to said wiring line and said operational amplifier through said certain switch circuit and said operational amplifier is responsive to the voltage from said buffer amplifier to generate the reset voltage.

3. The organic EL drive circuit IC as claimed in claim 2, wherein the voltage from said buffer amplifier is lower than the reset voltage.

4. The organic EL drive circuit IC as claimed in claim 1, wherein said organic EL display panel is of active matrix type and the reset voltage resets voltages of said capacitors of said pixel circuits.

* * * * *